US007070453B1

(12) United States Patent
Chen

(10) Patent No.: US 7,070,453 B1
(45) Date of Patent: Jul. 4, 2006

(54) SLIM FIVE-IN-ONE MEMORY CARD ADAPTER

(75) Inventor: Yuan-Hua Chen, LuChu Hsiang (TW)

(73) Assignee: Kingconn Technology Co., Ltd., Taoyuan (TW)

( * ) Notice: Subject to any disclaimer, the term of this patent is extended or adjusted under 35 U.S.C. 154(b) by 0 days.

(21) Appl. No.: 11/322,240

(22) Filed: Jan. 3, 2006

(51) Int. Cl.
*H01R 24/00* (2006.01)

(52) U.S. Cl. ..... 439/630; 439/159

(58) Field of Classification Search ..... 439/630, 439/638, 159, 945–946; 361/737
See application file for complete search history.

(56) References Cited

U.S. PATENT DOCUMENTS

| | | | | |
|---|---|---|---|---|
| 6,109,931 | A * | 8/2000 | Yotsutani | 439/76.1 |
| 6,231,360 | B1 * | 5/2001 | Horie | 439/159 |
| 6,272,017 | B1 * | 8/2001 | Klatt et al. | 361/737 |
| 6,524,137 | B1 * | 2/2003 | Liu et al. | 439/638 |
| 6,547,603 | B1 * | 4/2003 | Yu | 439/638 |

* cited by examiner

*Primary Examiner*—Michael C. Zarroli
(74) *Attorney, Agent, or Firm*—Rosenberg, Klein & Lee

(57) ABSTRACT

A slim five-in-one memory card adapter including a main body and different groups of contact fingers. The main body includes an internal slot and an external receptacle. The internal slot has grooves for fixing the different groups of contact fingers in place. The external receptacle is defined by a U-shaped body formed by side walls extending from the internal slot in such a way that the top and external sides thereof are open. A first side wall of the external receptacle is extended in a straight manner from the internal slot and has a height smaller than the height (t) of the MMC series memory cards while a second side wall thereof is tilted outward from the internal slot and has the same height as that of the internal slot. Meanwhile, a third side wall parallel to the first side wall is extended from the second side wall and has an equal height in comparison to that of the first side wall. the first, second, and third groups of contact fingers have a total of 13 contact fingers that are arranged on the main body, and wherein each of the flexible bent portions has a top surface higher than the first and second side walls, thereby forming a slim five-in-one memory card adapter including SD memory cards, MMC memory cards, MMC 4.0 memory cards, RS-MMC memory cards, and RS-MMC 4.0 memory cards.

4 Claims, 7 Drawing Sheets

SLIM FIVE-IN-ONE MEMORY CARD ADAPTER

BACKGROUND OF THE INVENTION

1. Field of the Invention

The invention relates to a slim five-in-one memory card adapter, and more particularly to a slim adapter available for use by five different memory cards including SD (Secure Digital) memory cards, MMC (Multi Media Card) memory cards, MMC 4.0 memory cards, RS-MMC (Reduced Size Multi Media Card) memory cards, and RS-MMC 4.0 memory cards.

2. Description of the Related Art

There are various types of memory cards in the market, and new types thereof are unceasingly developed. Different memory cards have their own dimensions and their conducting interface also have different contacts positions. Therefore, different memory cards have their corresponding slot for insertion. In order to facilitate the use of different memory cards, corresponding slots have to be combined in a single slot that is available for use by many memory cards in different specifications.

One of the most common memory cards in the market is SD memory card that has a conducting interface with nine contact pins at the bottom of the front end thereof. Another common memory card is MMC memory card that has a conducting interface with seven contact pins. Besides, RS-MMC memory card completely corresponds to MMC memory card except that RS-MMC memory card is shorter. Moreover, the MMC 4.0 memory card and RS-MMC 4.0 memory card completely correspond to the MMC memory card and the RS-MMC memory card, respectively except that the conducting interfaces of the MMC 4.0 memory card and RS-MMC 4.0 memory card both have 13 contact pins. To design a practical slot shared by five different memory cards requires many studies in the space arrangement. Otherwise, improper combination would result in a complicated structure and require a time-wasted and labor-intensive assembly. At present, a slim five-in-one memory card adapter does not exist in the market yet.

The applicant of the invention has disclosed a "Multipurpose Memory Card Adapter" (U.S. application Ser. No. 11/088,729 and TW 93210716) including a base and a cover. Meanwhile, contact fingers with different length are attached to the internal side, the external side, and the top side of the memory card adapter, thereby resulting in a complicated fabrication process. In addition, the dimensions cannot be minimized to fulfill the compact requirement of the digital products. Furthermore, this configuration is unfavorable for the design of the space arrangement. Therefore, it still leaves much to be desired.

SUMMARY OF THE INVENTION

A primary object of the invention is to provide a slim five-in-one memory card adapter in which the conventional top cover is removed for minimizing the dimensions of the whole structure. Three groups of contact fingers are arranged in the same direction to simplify the whole structure. Meanwhile, three side walls on the main body of the slim adapter have different height and forms for a convenient and reliable electric connection for the five memory cards in different specifications. Furthermore, all-in-one and compact requirements can be fulfilled, too.

In order to reach the above-mentioned object, the slim five-in-one memory card adapter in accordance with the invention includes:

a) a main body having an internal slot and an external receptacle, the internal slot having grooves for fixing different groups of contact fingers in place, the external receptacle being defined by a U-shaped body formed by side walls extending from the internal slot in such a way that the top and external sides thereof are open, a first side wall of the external receptacle being extended in a straight manner from the internal slot and having a height smaller than the height (t) of the MMC (Multi Media Card) series memory cards, a second side wall thereof being tilted outward from the internal slot and having the same height as that of the internal slot, a third side wall parallel to the first side wall being extended from the second side wall and having an equal height in comparison to that of the first side wall, the external receptacle including recesses for receiving the different groups of contact fingers, projecting ribs extending forwards from the internal slot, and lugs disposed at external sides of predetermined recesses, the height of the projecting ribs and the lugs not exceeding the height of the first and third side walls;

b) a first group of contact fingers having eight contact fingers that have smaller length and are inserted in parallel into the grooves, the contact fingers each including a flexible bent portion at the external side thereof, the bent portions being received within the corresponding recesses, respectively;

c) a second group of contact finger having only one contact finger that has middle length and is disposed in close vicinity to the inner wall of the second and third side walls, the internal side of the contact finger being inserted into the grooves while the external side thereof is substantially formed to be a flexible bent portion, the bent portion being received within the corresponding recess; and d) a third group of contact fingers having four contact fingers that have greater length and are inserted into the grooves, the contact fingers each having a flexible bent portion at the external side, the bent portions extending beyond the first contact fingers and being received within the corresponding recesses, respectively, wherein the first, second, and third groups of contact fingers have a total of 13 contact fingers that are arranged on the main body, and wherein each of the flexible bent portions has a top surface higher than the first and second side walls, thereby forming a slim five-in-one memory card adapter including SD memory cards, MMC memory cards, MMC 4.0 memory cards, RS-MMC memory cards, and RS-MMC 4.0 memory cards.

BRIEF DESCRIPTION OF THE FIGS.

DETAILED DESCRIPTION OF THE PREFERRED EMBODIMENT

Figure 1:
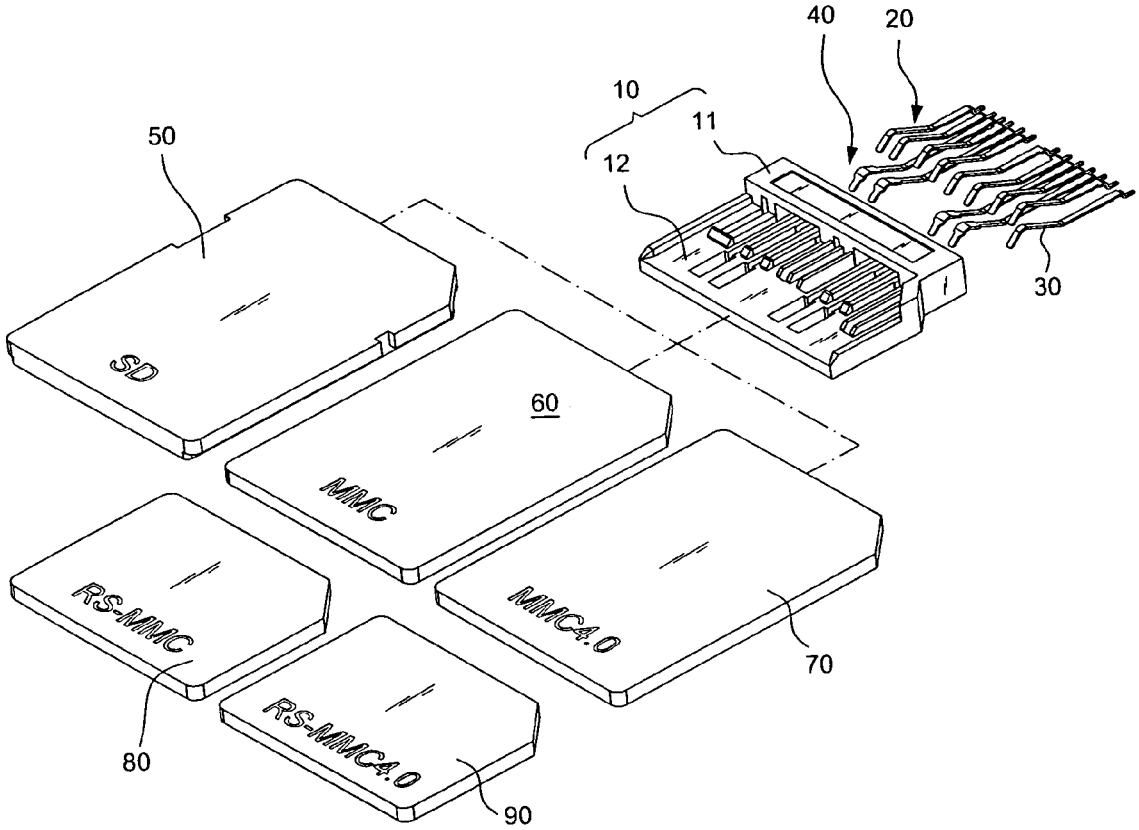
FIG. 1 is an exploded view of a structure of the invention.
Figure 2:
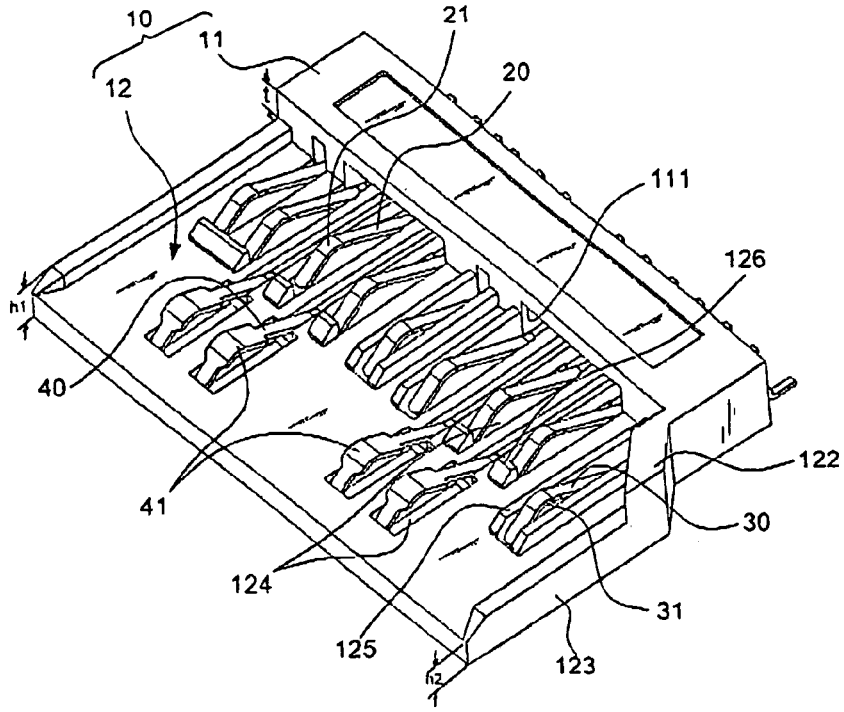
FIG. 2 is a perspective view of the invention.
Figure 3:
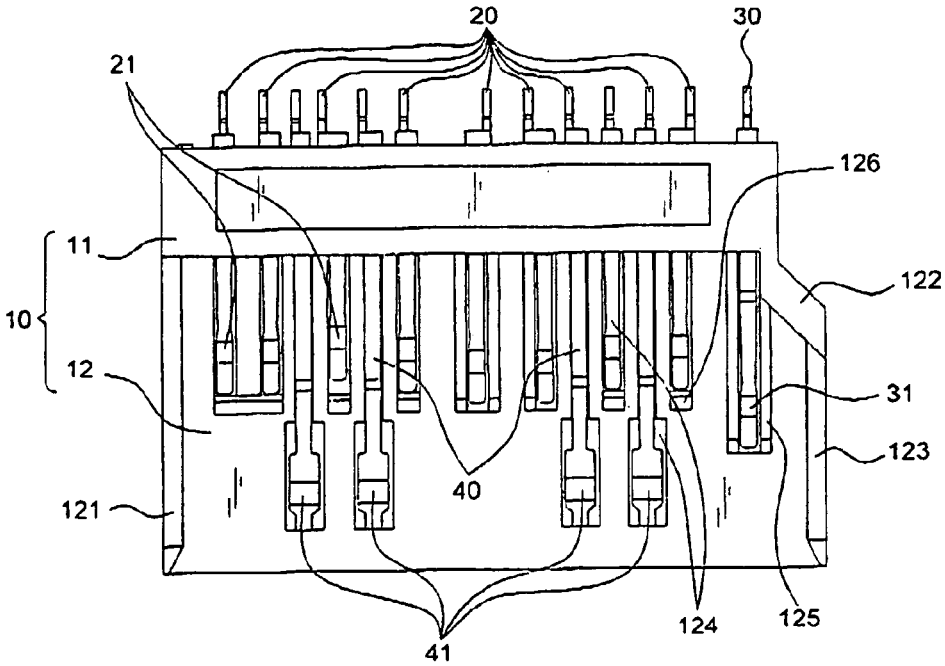
FIG. 3 is a top view of the invention.
Figure 4:
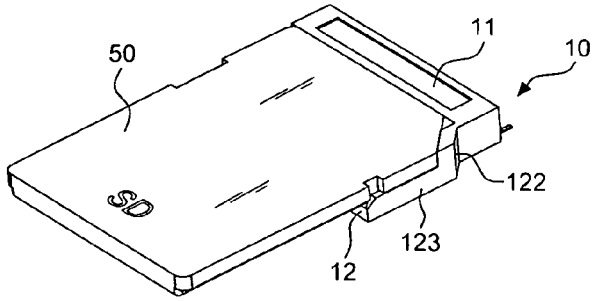
FIGS. 4A through 4E are perspective views of the invention for the insertion of five different memory cards.
Figure 4:
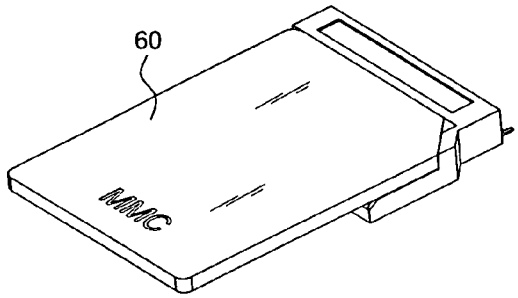
Figure 4:
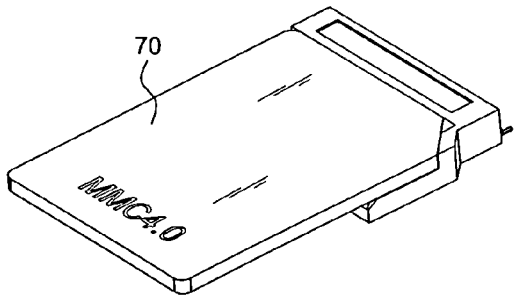
Figure 4:
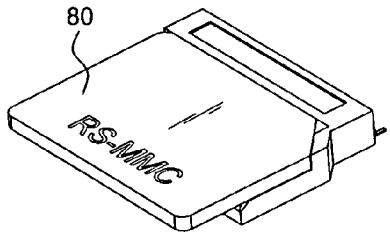
Figure 4:
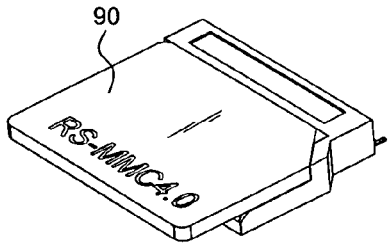

First of all, referring to FIGS. 1 through 3, a slim five-in-one memory card adapter in accordance with the invention includes a main body 10 and different groups of contact fingers 20, 30, 40.

The main body 10 includes an internal slot 11 and an external receptacle 12. The internal slot 11 has grooves 111 for fixing the different groups of contact fingers 20, 30, 40 in place (see FIG. 2). The external receptacle 12 is defined by a U-shaped body formed by side walls extending from the internal slot 11 in such a way that the top and external sides thereof are open. A first side wall 121 of the external receptacle 12 is extended in a straight manner from the internal slot 11 and has a height smaller than the height (t) of the MMC series memory cards while a second side wall 122 thereof is tilted outward from the internal slot 11 and has the same height as that of the internal slot 11. Meanwhile, a third side wall 123 parallel to the first side wall 121 is extended from the second side wall 122 and has an equal height in comparison to that of the first side wall 121 (h1=h2). Moreover, the external receptacle 12 includes recesses 124 for receiving the different groups of contact fingers, projecting ribs 125 extending forwards from the internal slot 11, and lugs 126 disposed at external sides of predetermined recesses 124. The height of the projecting ribs 125 and the lugs 126 should not exceed the height h1, h2 of the first and third side walls 121, 123.

In addition, the groups of contact fingers 30, 40 are mounted on the main body 10. Meanwhile, they are inserted in the same direction into the grooves 111.

The first group of contact fingers 20 has eight contact fingers that have smaller length and are inserted in parallel into the grooves 111. Each of the contact fingers 20 includes a flexible bent portion 21 at the external side thereof. The bent portions 21 are received within the corresponding recesses 124, respectively.

The second group of contact finger 30 has only one contact finger that has middle length and is disposed in close vicinity to the inner wall of the second and third side walls 122, 123. The internal side of the contact finger 30 is also inserted into the grooves 111 while the external side thereof is substantially formed to be a flexible bent portion 31. The bent portion 31 is received within the corresponding recess 124.

The third group of contact fingers 40 has four contact fingers that have greater length and are inserted into the grooves 111. Each of the contact fingers 40 has a flexible bent portion 41 at the external side. The bent portions 41 extend beyond the first contact fingers 20 and received within the corresponding recesses 124, respectively.

The groups of the contact fingers 20, 30, 40 have a total of 13 contact fingers that are arranged in parallel on the surface of the main body 10. All of the flexible bent portions 21, 31, 41 have a top surface located at a higher position (h1, h2) than the first and third side walls 121, 123. In this way, a slim adapter is formed and shared by five different memory cards of SD (50), MMC (60), MMC 4.0 (70), RS-MMC (80) and RS-MMC 4.0 (90).

Based on the above-mentioned design, the slim adapter in accordance with the invention can be available for use by the above-mentioned five memory cards. The use of the memory cards and the main body 10 is detailed one by one by the accompanying FIGS. 5A–5E and 6A–6E as followed.

Figure 5:
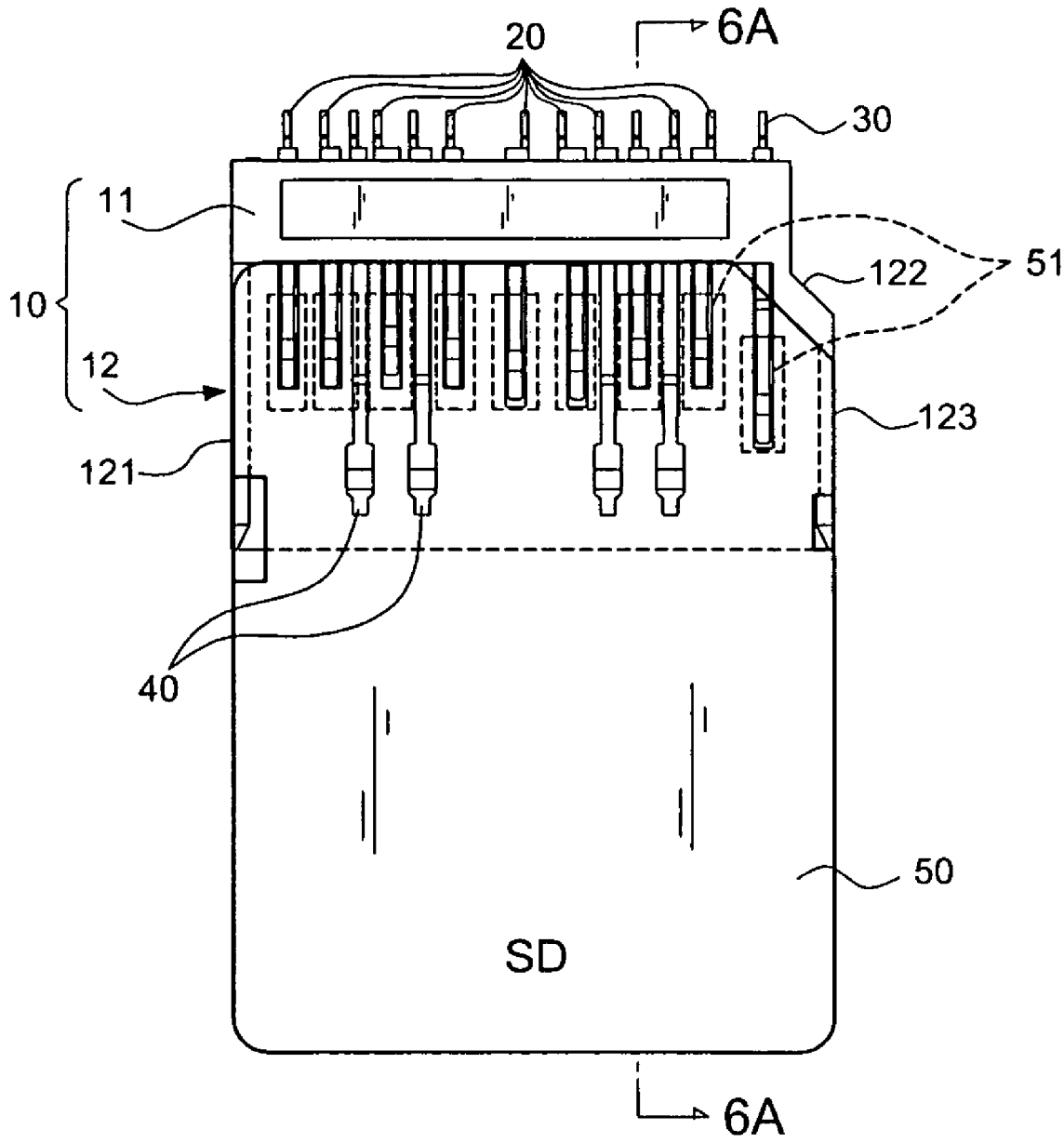
FIGS. 5A through 5E are top views of the invention for the insertion of the five different memory cards.
Figure 5:
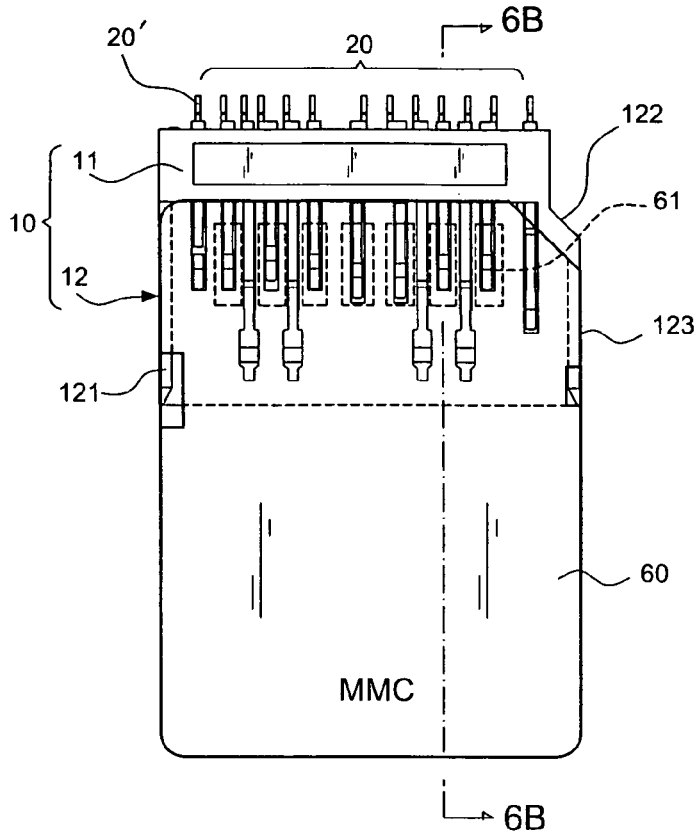
Figure 5:
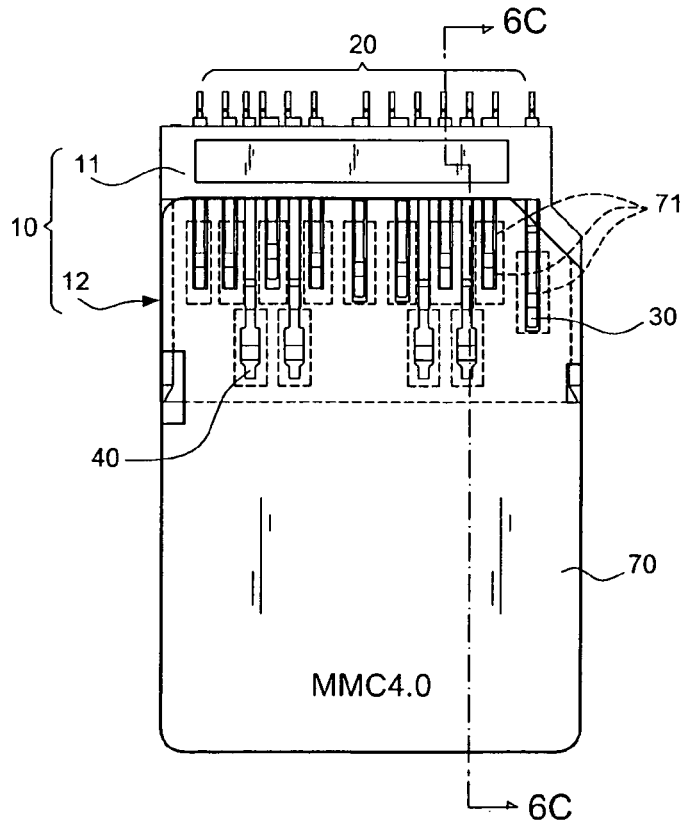
Figure 5:
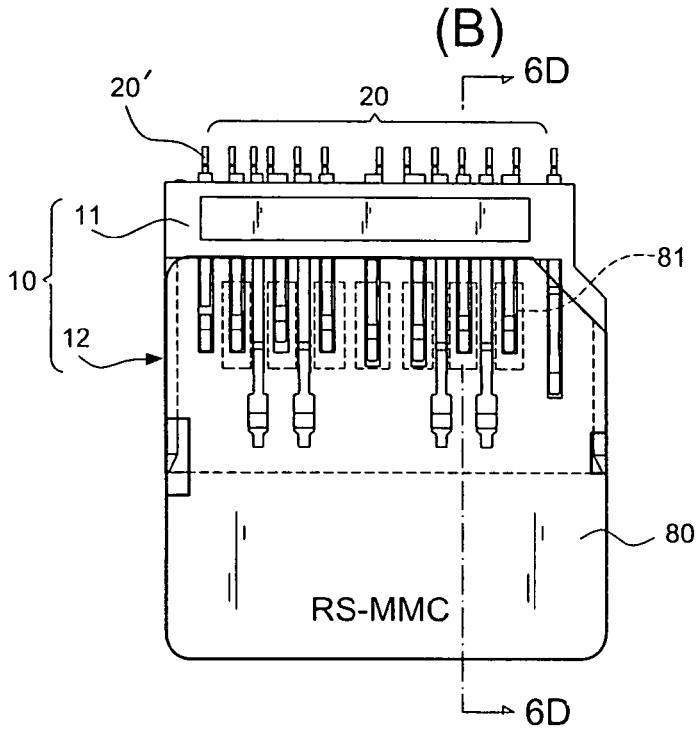
Figure 6:
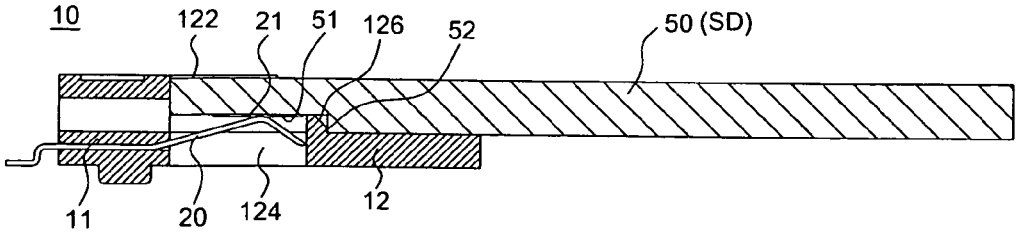
FIGS. 6A through 6E are cutaway views of the invention for the insertion of the five different memory cards.
Figure 6:
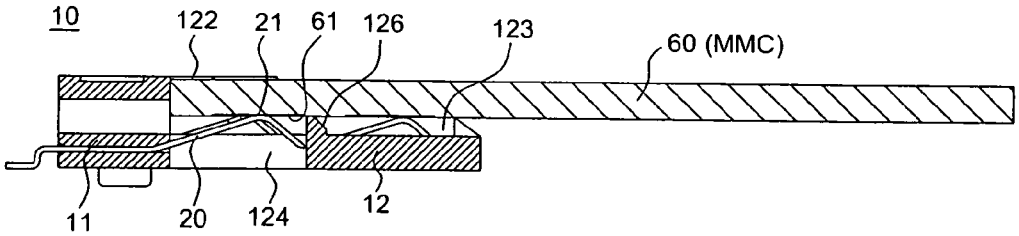
Figure 6:
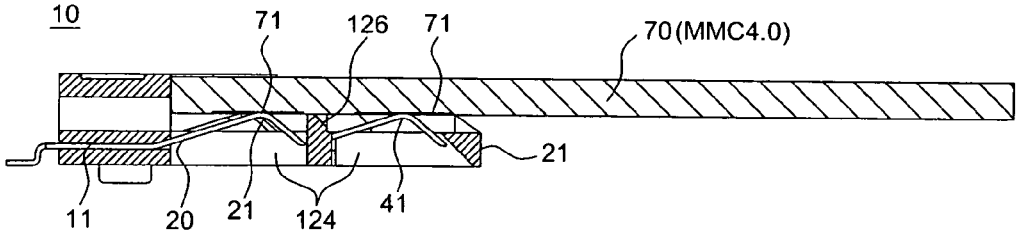
Figure 6:
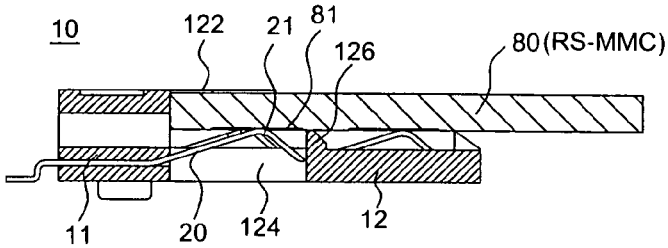
Figure 6:
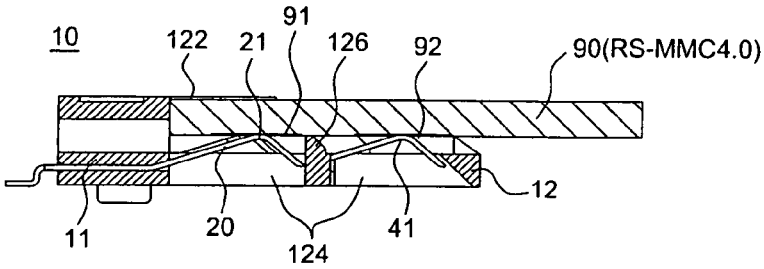

A First Application:

FIGS. 5A and 6A show a first application of the invention to an SD memory card 50 in a top view and a cutaway view, respectively. The SD memory card 50 includes a conducting interface 51 with nine contact pins that establishes the electric connection with eight of the first group of contact fingers 20 and the only one of the second group of contact finger 30, respectively. Meanwhile, the front end of the SD memory card 50 is pressed against the internal slot 11 and the second side wall 122. Besides, the both sides of the SD memory card 50 lie on the first and third side walls 121, 123 and are aligned therewith, respectively. The SD memory card 50 is thicker than the MMC series memory cards, and the elevation portion of the SD memory card 50 can be exactly received within the external receptacle 12. In addition, the lugs 126 block a side wall 52 of the elevation portion of the SD memory card 50, thereby providing a stable support for the SD memory card 50. Furthermore, the main body 10 of the invention does not have a cover at the top thereof. The main body 10 is directly installed within a housing of a digital product like card reader (not shown). The housing is used as cover of the main body 10, thereby reducing the whole thickness and production cost of the slim adapter. In this way, the digital product can be made lighter and more compact.

A Second Application:

FIGS. 5B and 6B show a second application of the invention to an MMC memory card 60 in a top view and a cutaway view, respectively. The same elements have the same reference sign. The MMC memory card 60 includes a conducting interface 61 with seven contact pins that establishes the electric connection with seven of the first group of contact fingers 20 while the leftmost contact finger 20' remains untouched. Meanwhile, the front end of the MMC memory card 60 corresponds to that of the SD memory card 50. Therefore, the front end of the MMC memory card 60 is pressed against the internal slot 11 and the second side wall 122 while both sides of the MMC memory card 60 are extended between the first and third side walls 121, 123. The MMC series memory cards are thinner than SD memory card 50 so that the both sides of the MMC memory card 60 lie on the first and third side walls 121, 123 while the middle part thereof is supported on the lugs 126. As shown in FIG. 6B, the height of the MMC memory card 60 does not exceed the internal slot 11, the first side wall 121, and the second side wall 122 of the main body 10. In other words, the height of the first and second side walls 121, 122 of the main body 10 is smaller than the thickness (t) of the internal slot 11. Therefore, the insertion or removal of the MMC memory card 60 won't be affected when the main body 10 is installed within the housing of a digital product.

A Third Application:

FIGS. 5C and 6C show a third application of the invention to an MMC 4.0 memory card 70 in a top view and a cutaway view, respectively. The same elements have the same reference sign. Since the contour of the MMC 4.0 memory card 70 corresponds to that of the MMC memory card 60, no further description thereto are given hereinafter. The difference lies in that the conducting interface 71 of the MMC 4.0 memory card 70 has a total of 13 contact pins that establish the electric connection with all of the 13 contact fingers 20, 30, 40. All of the contact fingers 20, 30, 40 are extended from the internal slot 11 and arranged in parallel in the same direction, thereby minimizing the length of the external receptacle 12. In the way, the light and compact configuration can be ensured.

A Fourth Application:

FIGS. 5D and 6D show a fourth application of the invention to an RS-MMC memory card 80 in a top view and a cutaway view, respectively. The RS-MMC memory card 80 completely corresponds to the MMC memory card 60 except that the RS-MMC memory card 80 is shorter than the MMC memory card 60. The RS-MMC memory card 80 has a conducting interface 81 with seven contact pins as well. The electric connection has been depicted above so that no further descriptions are given hereinafter.

Figure 5E:
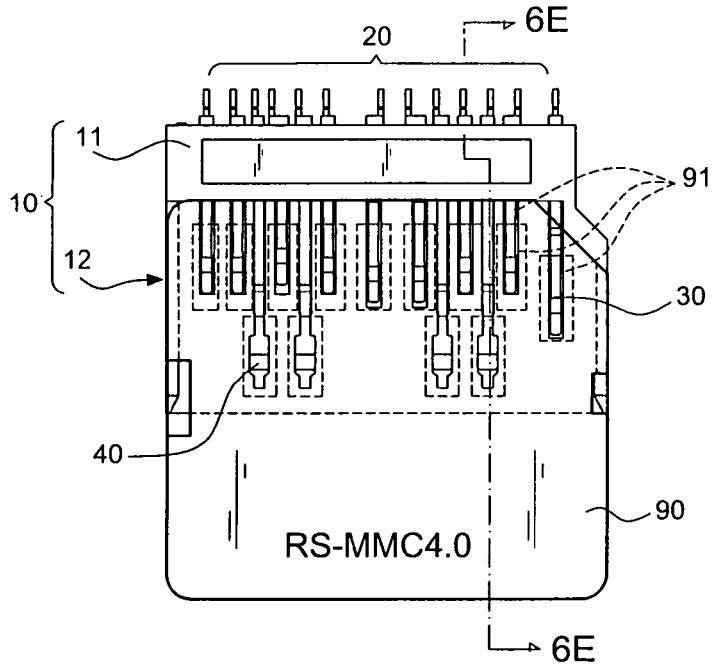

A Fifth Application:

FIGS. 5E and 6E show a fifth application of the invention to an RS-MMC 4.0 memory card 90 in a top view and a cutaway view, respectively. The RS-MMC 4.0 memory card 90 completely corresponds to the MMC 4.0 memory card 70 except that the RS-MMC 4.0 memory card 90 is shorter than the MMC 4.0 memory card 70. The RS-MMC 4.0 memory card 90 has a conducting interface 91 with 13 contact pins as well. The electric connection has been depicted above so that no further descriptions are given hereinafter.

Based on the above-mentioned configurations, the slim adapter in accordance with the invention is available for use by five different memory cards. Meanwhile, it is the slimmest one in the market. Therefore, this invention can be regarded as being patentable.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A slim five-in-one memory card adapter, comprising:

a) a main body having an internal slot and an external receptacle, the internal slot having grooves for fixing different groups of contact fingers in place, the external receptacle being defined by a U-shaped body formed by side walls extending from the internal slot in such a way that the top and external sides thereof are open, a first side wall of the external receptacle being extended in a straight manner from the internal slot and having a height smaller than the height (t) of the MMC (Multi Media Card) series memory cards, a second side wall thereof being tilted outward from the internal slot and having the same height as that of the internal slot, a third side wall parallel to the first side wall being extended from the second side wall and having an equal height in comparison to that of the first side wall, the external receptacle including recesses for receiving the different groups of contact fingers, projecting ribs extending forwards from the internal slot, and lugs disposed at external sides of predetermined recesses, the height of the projecting ribs and the lugs not exceeding the height of the first and third side walls;

b) a first group of contact fingers having eight contact fingers that have smaller length and are inserted in parallel into the grooves, the contact fingers each including a flexible bent portion at the external side thereof, the bent portions being received within the corresponding recesses, respectively;

c) a second group of contact finger having only one contact finger that has middle length and is disposed in close vicinity to the inner wall of the second and third side walls, the internal side of the contact finger being inserted into the grooves while the external side thereof is substantially formed to be a flexible bent portion, the bent portion being received within the corresponding recess; and d) a third group of contact fingers having four contact fingers that have greater length and are inserted into the grooves, the contact fingers each having a flexible bent portion at the external side, the bent portions extending beyond the first contact fingers and being received within the corresponding recesses, respectively, wherein the first, second, and third groups of contact fingers have a total of 13 contact fingers that are arranged on the main body, and wherein each of the flexible bent portions has a top surface higher than the first and second side walls, thereby forming a slim five-in-one memory card adapter including SD (Secure Digital) memory cards, MMC memory cards, MMC 4.0 memory cards, RS-MMC (Reduced Size Multi Media Card) memory cards, and RS-MMC 4.0 memory cards.

2. The slim five-in-one memory card adapter as recited in claim 1 wherein eight of the first group of contact fingers and one of the second group of contact finger have a total of nine contact fingers that are pressed against a conducting interface on the bottom of the SD memory card for an electric connection when the SD memory card is attached to the main body.

3. The slim five-in-one memory card adapter as recited in claim 1 wherein seven of the first group of contact fingers is pressed against a conducting interface on the bottom of the MMC and RS-MMC memory cards for an electric connection when MMC and RS-MMC memory cards are attached to the main body, respectively.

4. The slim five-in-one memory card adapter as recited in claim 1 wherein all 13 of the first, second and third groups of contact fingers are pressed against a conducting interface on the bottom of the MMC 4.0 and RS-MMC 4.0 memory cards for an electric connection when the MMC 4.0 and RS-MMC 4.0 memory cards are attached to the main body, respectively.

* * * * *